US009199135B2

(12) United States Patent
Severa et al.

(10) Patent No.: US 9,199,135 B2
(45) Date of Patent: Dec. 1, 2015

(54) OPTIMIZED THERMOPLASTIC RACQUET

(71) Applicant: Wilson Sporting Goods Co., Chicago, IL (US)

(72) Inventors: William D. Severa, Darien, IL (US); Scott M. Doyle, Oak Park, IL (US); David A. Vogel, Island Lake, IL (US); Robert T. Kapheim, Chicago, IL (US); Robert T. Thurman, Plainfield, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 384 days.

(21) Appl. No.: 13/686,469

(22) Filed: Nov. 27, 2012

(65) Prior Publication Data

US 2014/0148275 A1 May 29, 2014

(51) Int. Cl.

*A63B 49/02* (2015.01)
*A63B 49/10* (2015.01)
*A63B 49/08* (2015.01)

(52) U.S. Cl.

CPC ..... *A63B 49/10* (2013.01); *A63B 49/0294* (2013.01); *A63B 49/08* (2013.01); *A63B 49/027* (2013.01); *A63B 2049/0205* (2013.01); *A63B 2209/00* (2013.01)

(58) Field of Classification Search

USPC ..... 473/524, 531, 535, 536, 539, 540, 541, 473/542

See application file for complete search history.

(56) References Cited

U.S. PATENT DOCUMENTS 3,647,211 A 3/1972 Doessel et al. ..... 273/73
3,981,504 A 9/1976 Gugel ..... 273/73
3,998,457 A * 12/1976 Dempsey et al. ..... 473/535
4,029,317 A * 6/1977 Malmstrom ..... 473/540
4,413,822 A 11/1983 Fernandez et al. ..... 273/73
4,440,392 A 4/1984 Popplewell ..... 273/73
4,505,480 A 3/1985 Vanhoutte ..... 273/73
4,643,857 A 2/1987 Cousin et al. ..... 264/46.6
4,770,915 A 9/1988 Nakagawa et al. ..... 428/74
4,989,870 A * 2/1991 Janes ..... 473/537
5,151,322 A 9/1992 Kimoto et al. ..... 428/303
5,176,868 A 1/1993 Davis ..... 264/257
5,198,058 A 3/1993 You ..... 156/173
5,232,220 A * 8/1993 Poschenrieder ..... 473/535
5,326,097 A * 7/1994 Yu ..... 473/528

(Continued)

FOREIGN PATENT DOCUMENTS

DE 10 43 897 11/1958
DE 10 89 675 9/1960

(Continued)

*Primary Examiner* — Nini Legesse

(74) *Attorney, Agent, or Firm* — Terence P. O'Brien

(57) ABSTRACT

A sports racquet extending along a longitudinal axis and configured for supporting a quantity of racquet string generally about a string plane. The racquet includes a frame formed of a thermoplastic material and including a head portion and a handle portion. The head portion is formed of first and second hoop regions. At least one of the first and second hoop regions includes a first set of projections extending from one of the first and second hoop regions across the string plane and engaging the other of the first and second hoop regions. The first set of projections space apart the first and second hoop regions by a first predetermined dimension to define a plurality of through-hoop region openings. The handle portion is formed of first and second handle regions directly coupled together without defining either a plurality of handle openings.

20 Claims, 17 Drawing Sheets

(56) References Cited

U.S. PATENT DOCUMENTS

| | | | | |
|---|---|---|---|---|
| 5,419,554 | A | 5/1995 | Krone et al. | 273/73 |
| 5,456,591 | A | 10/1995 | Lo | 425/374 |
| 5,464,210 | A | 11/1995 | Davis et al. | 273/73 |
| 5,540,877 | A | 7/1996 | Repetto et al. | 264/513 |
| 5,551,689 | A * | 9/1996 | Svoma et al. | 473/535 |
| 5,556,677 | A | 9/1996 | Quigley et al. | 428/36.2 |
| 5,575,875 | A | 11/1996 | Brittingham et al. | 156/175 |
| 5,897,447 | A | 4/1999 | Nishihara | 473/535 |
| 5,922,255 | A * | 7/1999 | McLeod | 264/40.1 |
| 6,071,203 | A * | 6/2000 | Janes et al. | 473/535 |
| 6,500,080 | B2 | 12/2002 | Severa et al. | 473/521 |
| 6,663,516 | B2 | 12/2003 | Moon et al. | 473/521 |
| 6,840,874 | B2 | 1/2005 | Severa et al. | 473/521 |
| 6,964,624 | B2 * | 11/2005 | Shen et al. | 473/521 |
| 7,297,080 | B2 | 11/2007 | Severa et al. | 473/536 |
| 7,824,770 | B2 | 11/2010 | Honma et al. | 428/373 |
| 8,088,320 | B1 | 1/2012 | Bedard | 264/257 |
| 2005/0181896 | A1 * | 8/2005 | Severa et al. | 473/535 |
| 2007/0152373 | A1 | 7/2007 | Wang et al. | 264/322 |

FOREIGN PATENT DOCUMENTS

| | | |
|---|---|---|
| GB | 1 201 649 | 8/1970 |
| GB | 2 150 444 | 7/1985 |
| GB | 2150444 A * | 7/1985 |
| WO | WO 00/09219 | 2/2000 |

* cited by examiner

OPTIMIZED THERMOPLASTIC RACQUET

RELATED APPLICATIONS

The present application is related to co-pending U.S. patent application Ser. Nos. 13/686,486, 13/686,525 and 13/686,542 each filed on the same day herewith by William D. Severa, Scott M. Doyle, David A. Vogel, Robert T. Kapheim and Robert T. Thurman, and each entitled OPTIMIZED THERMOPLASTIC RACQUET, the full disclosure of which are hereby incorporated by reference.

FIELD OF THE INVENTION

The present invention relates generally to a sports racquet. In particular, the present invention relates to a racquet formed of a thermoplastic material including a thermoplastic resin and a plurality of fiber segments.

BACKGROUND OF THE INVENTION

Sport racquets, such as tennis racquets, are well known and typically include a frame having a head portion coupled to a handle portion. The head portion supports a string bed having a plurality of main string segments alternately interwoven with a plurality of cross string segments. Many racquets also include a throat portion positioned between and connecting the handle portion to the head portion. Sports racquets were initially primarily made of wood. Wood racquets were largely superseded by racquets formed of aluminum and other alloys. Aluminum racquets significantly improved the durability and reliability of racquets while increasing the power and strength of the racquets. Typically, aluminum racquets are formed of a drawn or extruded tube curved to substantially form a hoop with the two ends drawn together to form the throat tubes and the handle of the racquet. Today, many racquets are formed at least in part of a fiber composite material. Typically, bundles of high tensile strength fibers, such as carbon or graphite fibers, are coaxially aligned and intermixed with a resin typically formed of a thermoset material into sheets or layers of uncured fiber composite material. Multiple layers of uncured fiber composite material are typically carefully wrapped over a mandrel or an inflated tube to form the shape of a racquet. The wrapped layers are then placed into a mold and cured under heat and pressure to produce a fiber composite racquet frame. Racquets formed of fiber composite material have many advantageous characteristics, such as, for example, being lightweight, providing more design flexibility, and providing exceptional power, control and/or feel.

However, racquets formed of aluminum or fiber composite materials include some drawbacks. Aluminum is becoming increasing expensive and more difficult to obtain and process for applications such as sports racquets. The supply and manufacturing expertise of aluminum is becoming in increasing short supply. Fiber composite materials have similar drawbacks with respect to increased cost and inconsistent supply. Further, the man-hours required to produce high quality fiber composite racquets are significant. Some prior art racquets have been produced of a thermoplastic material typically through an injection molding process. However such racquets have not been widely used due to poor reliability and durability issues, and undesirable feel and performance characteristics.

Thus, there is a continuing need for a racquet that can be produced in a cost effective and reliable manner while providing exceptional performance, reliability and durability. What is needed is a racquet design that can provide greater design flexibility enabling racquets to be produced to meet different applications, and characteristics desired by players of various skill levels, engagement levels and budgets. It would be advantageous to provide a racquet that can be produced quickly and cost effectively without negatively effecting performance, feel, durability or playability. There is also a need for a racquet that can meet these needs without being a radical departure in look and design from traditional sport racquet designs.

SUMMARY OF THE INVENTION

The present invention provides a sports racquet extending along a longitudinal axis and configured for supporting a quantity of racquet string generally about a string plane. The racquet includes a frame formed of a thermoplastic material and including a head portion and a handle portion. The head portion is formed of first and second hoop regions. At least one of the first and second hoop regions includes a first set of projections extending from one of the first and second hoop regions across the string plane and engaging the other of the first and second hoop regions. The first set of projections space apart the first and second hoop regions by a first predetermined dimension to define a plurality of through-hoop region openings. The handle portion is formed of first and second handle regions directly coupled together without defining either a plurality of handle openings.

According to a principal aspect of a preferred form of the invention, a sports racquet extends along a longitudinal axis and is configured for use with a quantity of racquet string about a string plane. The racquet includes a frame formed of a thermoplastic material. The frame includes first and second halves. The first and second halves include first and second spaced apart hoop regions, first and second handle regions, first and second mating surfaces and first and second outer surfaces, respectively. At least one of the first and second halves includes a set of projections that extend from at least one of the first and second mating surfaces and across the string plane. At least one of the first and second halves defines a set of bores. The set of projections is configured to matably engage the set of bores. At least two of the projections extending from at least one of the first and second hoop regions are stepped projections having a proximal section and a distal section. The transverse cross-sectional area of the proximal section measured with respect to the string plane is greater than the transverse cross-sectional area of the distal section measured with respect to the string plane. At least two of the set of bores of at least one of the first and second hoop portions is configured to receive the corresponding distal sections, but not the proximal sections, of the at least two stepped projections.

According to another principal aspect of a preferred form of the invention, a sports racquet extends along a longitudinal axis and is configured for use with a quantity of racquet string about a string plane. The racquet includes a frame formed of a thermoplastic material. The frame includes a first frame half coupled to a second frame half. The first and second halves include first and second hoop regions, and first and second handle regions, respectively. The first and second handle regions include first and second distal end sections, first and second proximal sections and first and second central sections, respectively. The first and second proximal end sections include transversely extending end wall segments that form a butt end wall. The transverse cross-sectional area with respect to a plane perpendicular to the string plane of the coupled first and second proximal ends is greater than the transverse cross-sectional area with respect to a plane perpendicular to the string plane of the coupled first and second distal end sections.

According to another principal aspect of a preferred form of the invention, a sports racquet extends along a longitudinal axis and is configured for use with a quantity of racquet string forming a string bed about a string plane. The racquet includes a frame formed of a thermoplastic material. The frame includes first and second halves. The first and second halves include first and second spaced apart hoop regions, and first and second handle regions, respectively. At least one of the first and second hoop regions includes a set of projections extending from at least one of the first and second hoop regions in a direction orthogonal to the string plane. At least one of the first and second hoop regions defines a set of bores. The set of projections is configured to matably engage the set of bores. The set of projections extend through the string plane and define curved bearing surfaces configured for engaging and supporting the racquet string. The set of projections include at least first and second projections having at least first and second radii of curvature, respectively. The first radius of curvature being at least 0.5 mm greater than the second radius of curvature. The curved bearing surfaces of the set of projections have a radius of curvature within the range of greater than 2.0 to 12.0 mm.

According to another principal aspect of a preferred form of the invention, a sports racquet extends along a longitudinal axis and is configured for use with a quantity of racquet string forming a string bed about a string plane. The racquet includes a frame formed of a thermoplastic material including a thermoplastic resin and a plurality of fiber segments. The frame includes first and second halves. The first and second halves include first and second spaced apart hoop regions, and first and second handle regions, respectively. At least one of the first and second hoop regions includes a set of projections extending from at least one of the first and second hoop regions in a direction orthogonal to the string plane. At least one of the first and second hoop regions defines a set of bores. The set of projections is configured to matably engage the set of bores. The set of projections extends through the string plane and defines curved bearing surfaces configured for engaging and supporting the racquet string. At least two of the set of projections define a cross-sectional area when measured with respect to the string plane that is selected from the group consisting of semi-circular, elliptical, semi-elliptical, D-shaped, U-shaped, C-shaped, other non-circular curved shapes and combinations thereof.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
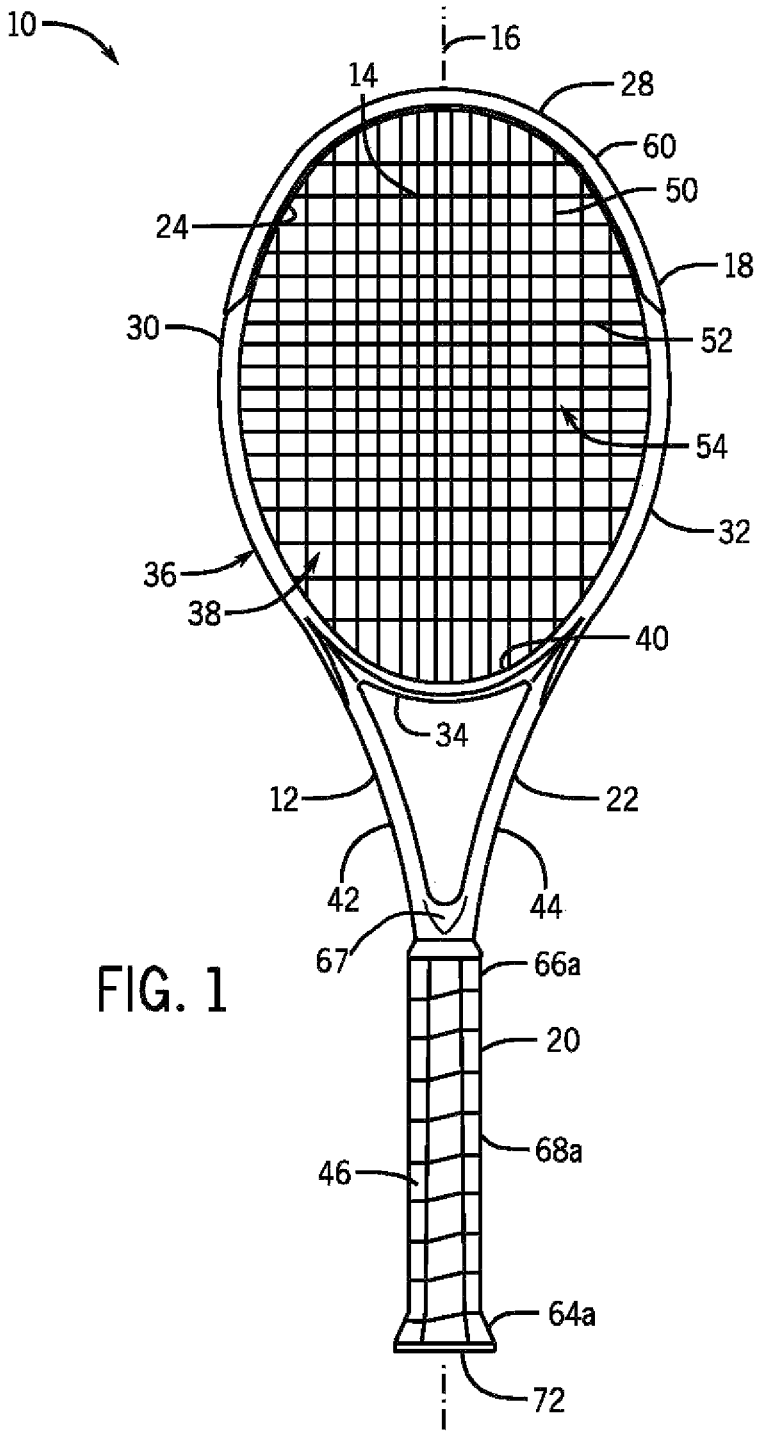
FIG. 1 is a front side perspective view of a racquet in accordance with a preferred embodiment of the present invention.

Referring to FIG. 1, a sports racquet is indicated generally at 10. The racquet 10 of FIG. 1 is configured as a tennis racquet. The racquet 10 includes a frame 12 and a string bed 14. The frame 12 extends along a longitudinal axis 16 and including a head portion 18, a handle portion 20, and a throat portion 22 coupling the head and handle portions 18 and 20.

The head portion 18 includes a distal region 28, first and second side regions 30 and 32, and a proximal region 34, which collectively define a hoop 36 having a string bed area 38 for receiving and supporting the string bed 14. In one preferred embodiment, the proximal region 34 includes a yoke 40. The string bed area 38 is also referred to as the head size of the racquet 10. In a preferred embodiment, the head size or string bed area 38 of the racquet 10 is within the range of 80 to 135 square inches. In a more preferred embodiment, the head size of the racquet 10 is within the range 98 to 115 square inches. In alternative preferred embodiments, other head sizes can also be used and are contemplated under the present invention. The hoop 36 can be any closed curved shape including, for example, a generally oval shape, a generally tear-drop shape, a generally pear shape, a generally circular shape and combinations thereof The head portion 18 is configured for supporting the string bed 14 formed by a plurality of main string segments 50 alternately interwoven or interlaced with a plurality of cross string segments 52. The string bed 14 defines a string plane 54 as it extends about the string bed area 38. The main and cross string segments 50 and 52 can be formed of a high tensile strength, flexible material. In preferred embodiments, the racquet string can be formed of a polyester material, a nylon, a natural gut material and/or a synthetic gut material. The polyester materials used to make the racquet string can include polyether ether ketone (PEEK), polytetrafluoroethylene (PTFE), other polyester materials, and combinations thereof The racquet string can be formed in a monofilament construction or in a multiple-filament construction. The racquet string can be formed of various different diameters (or gauges). Preferably, the diameter of the racquet string is within the range 1.10 to 1.55 mm.

The throat portion 22 can be formed of first and second throat tubes 42 and 44 generally extending from the head portion 18 and converging toward the handle portion 20. The handle portion 20 includes a grip 46 for grasping by a player.

Figure 12:
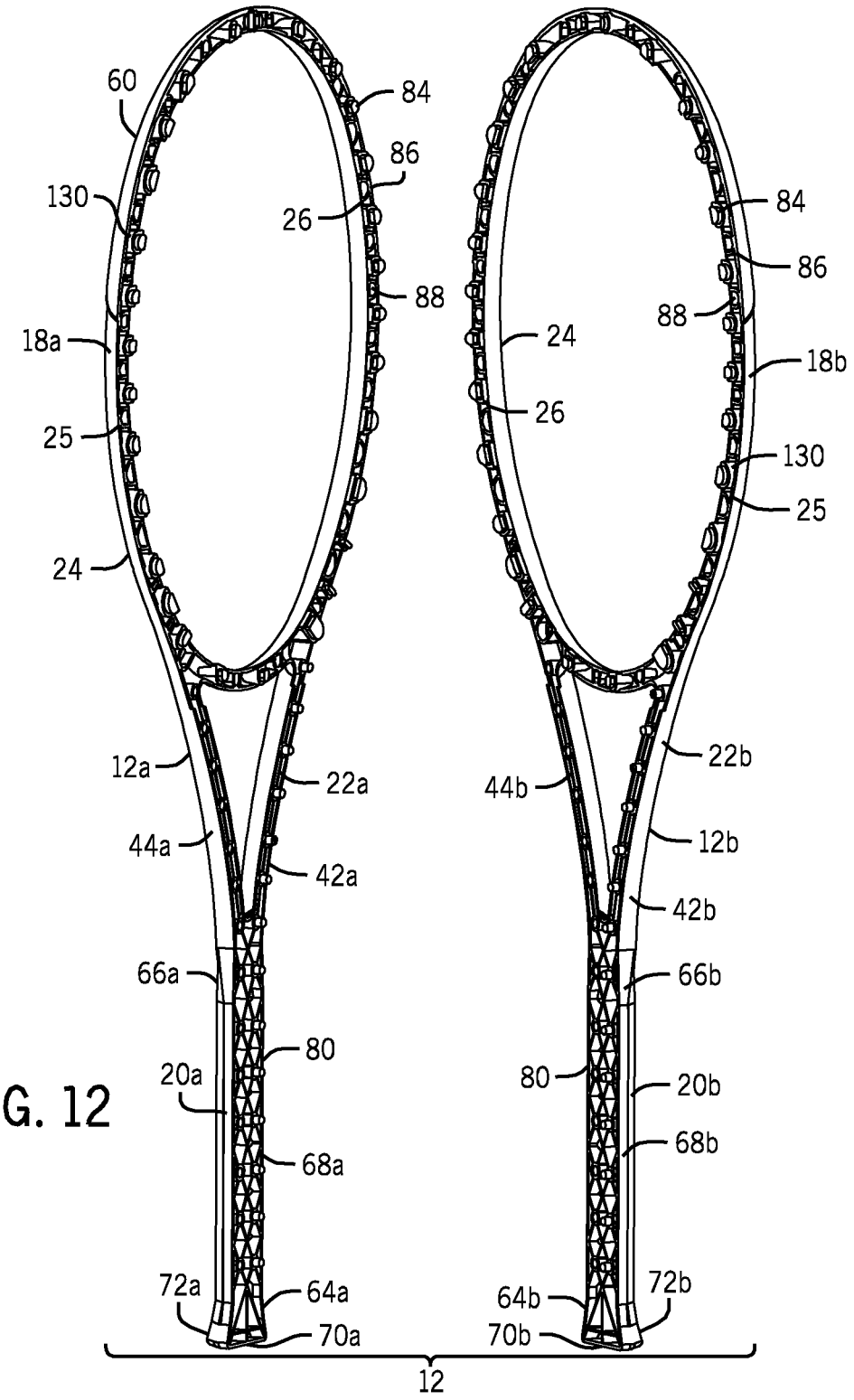
FIG. 12 is a side perspective view of first and second halves of the frame of the racquet of FIG. 1 shown spaced apart from each other.

The frame 12 is preferably a two piece structure formed of first and second frame halves 12*a* and 12*b* (see FIG. 12). Each of the first and second frame halves 12*a* and 12*b* is preferably formed of a thermoplastic material. In a preferred embodiment, the thermoplastic material includes a thermoplastic resin and a plurality of fiber segments. The thermoplastic material offers many advantageous characteristics that are beneficial for the design and use of a sports racquet including providing exceptional feel, high strength, toughness, durability, reliability, consistency, cost-effectiveness, ease of construction, and exceptional performance. The thermoplastic resin is preferably a nylon. In alternative preferred embodiments, the thermoplastic resin can be polystyrene, polycarbonate, polyphenylene sulfide, polyether ether ketone (PEEK), polytetrafluoroethylene (PTFE), acrylonitrile-butadiene-styrene (ABS), acetal, phenylene oxide, vinyl, polyvinyl chloride (PVC), polyamide, polyurethane, polyethylene terephthalate (PET), polypropylene, other polyethylenes, and combinations thereof. The plurality of fibers are typically co-axially aligned and arranged in bundles. The fibers are formed of a high tensile strength material such as carbon. Alternatively, the fibers can be formed of other materials such as, for example, glass, graphite, boron, basalt, carrot, aramid, Kevlar®, Spectra®, poly-para-phenylene-2,6-benzobisoxazole (PBO), hemp, flax, and combinations thereof. The fibers are preferably cut to a length within the range of 1 mm to 75 mm. In a particularly preferred embodiment, the fibers are cut to a length within the range of 1 to 10 mm. The fibers are preferably randomly orientated and dispersed within the thermoplastic resin prior to injection or during the injection molding process. In alternative preferred embodiments, the fibers can be generally aligned in one, two or more primary directions prior to or during the injection molding process. The fibers preferably account for a percentage of the weight of the thermoplastic material within the range of 10 to 60 percent. In a preferred embodiment, the fibers account for 25 to 35 percent of the weight of the thermoplastic material. The fibers preferably account for a percentage of the volume of the thermoplastic material within the range of 10 to 40 percent. In a preferred embodiment, the fibers account for 25 to 35 percent of the volume of the thermoplastic material. In an alternative preferred embodiment, the thermoplastic material can be formed without a plurality of fibers.

The frame 12 is preferably formed of a thermoplastic material having a durometer value within the range of 20 on the Shore A hardness scale to 40 on the Shore D hardness scale.

Figure 2:
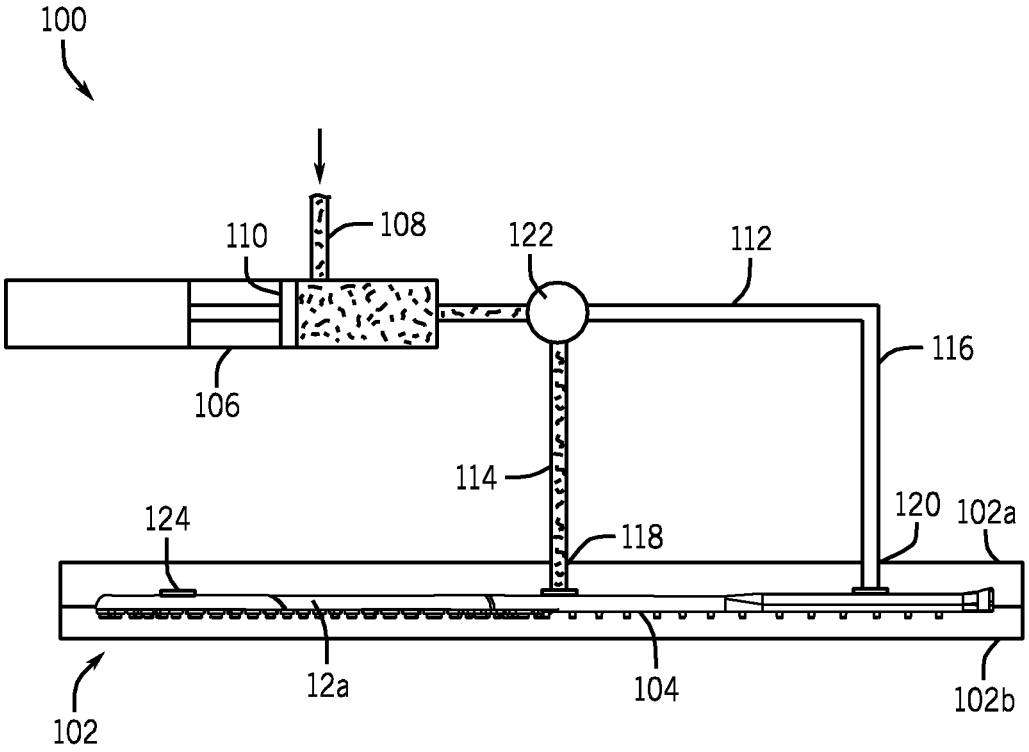
FIG. 2 is a schematic depiction of an injection molding apparatus.

Referring to FIG. 2, the thermoplastic material is preferably formed into the desired structure (e.g. the frame halves 12*a* and 12*b*) through an injection molding process or operation using an injection molding apparatus 100. The injection molding apparatus 100 can include a water cooled injection mold 102 having a mold cavity 104 that defines the shape of the frame half 12*a*. The mold 102 can be a split mold having two major sections 102*a* and 102*b*. The thermoplastic material can be injected into the mold cavity 104 from an injection molding extruder 106. The thermoplastic material can be supplied through an inlet tube 108 to the interior of the extruder 106, which is heated to reduce the viscosity of the thermoplastic material and make it flowable. A piston or screw 110 can be used to force the flowable thermoplastic material out of the extruder 106 into a manifold system 112, which can be heated. The manifold system 112 can include one, two, three or more flow paths, such as flowpaths 114 and 116, for routing the flowable thermoplastic material to first and second injection ports 118 and 120, respectively. The locations of the injection ports 118 and 120 are spaced apart to enable the thermoplastic material to readily flow and fill the mold cavity 104 in an efficient and timely manner. The injection of the flowable thermoplastic material can be performed in two stages through the use of one or more valves 122. In one stage, the flow of the thermoplastic material can be directed through a specific injection flowpath, such as flowpath 114 through the first injection port 118. The direction and flowpath of flowable thermoplastic material can be used to facilitate the general orientation of the fibers within the thermoplastic material. One or more pressure sensors 124 or other forms of sensor, such as temperature sensors, can be utilized with the mold to determine when the flowable thermoplastic material has reached selected locations within the mold cavity. When the flow of the thermoplastic material reaches a predetermined value, such as a predetermined pressure at one of the pressure sensors 124, the valve 122 can reposition and reroute or redirect the flow of the thermoplastic material down the second flowpath 116 through the second injection port 120. In alternative preferred embodiments, other forms of injection mold apparatuses can be used. The type of mold, the number of flow paths, the number of injections ports or gates, the number of valves, the configuration of the valves, the type of extruder or other injection mechanism, the configuration, pressure, temperature and order of the flow and introduction of the thermoplastic material can be varied. The injection molding apparatus described above is one example and is not intended to be limiting. One of skill in the art understands that a wide variety of injection molding apparatuses can be used to achieve the desired result from injection molding process or operation.

Referring to FIG. 12, the frame 12 is formed of the first and second frame halves 12*a* and 12*b* that include first and second hoop regions 18*a* and 18*b*, first and second handle regions 20*a* and 20*b* and first and second throat regions 22*a* and 22*b*, respectively. Each of the first and second frame halves 12*a* and 12*b* are formed within the mold cavity 104 of the injection molding apparatus 100 (or an equivalent injection mold apparatus). In a preferred embodiment, the first and second halves 12*a* and 12*b* are identical halves. Accordingly, a reference to a component of the first frame half 12*a* is equally applicable to the same component of the second frame half 12*b* (e.g. the first hoop region 18*a* is preferably the same as the second hoop region 18*b*).

Figure 3:
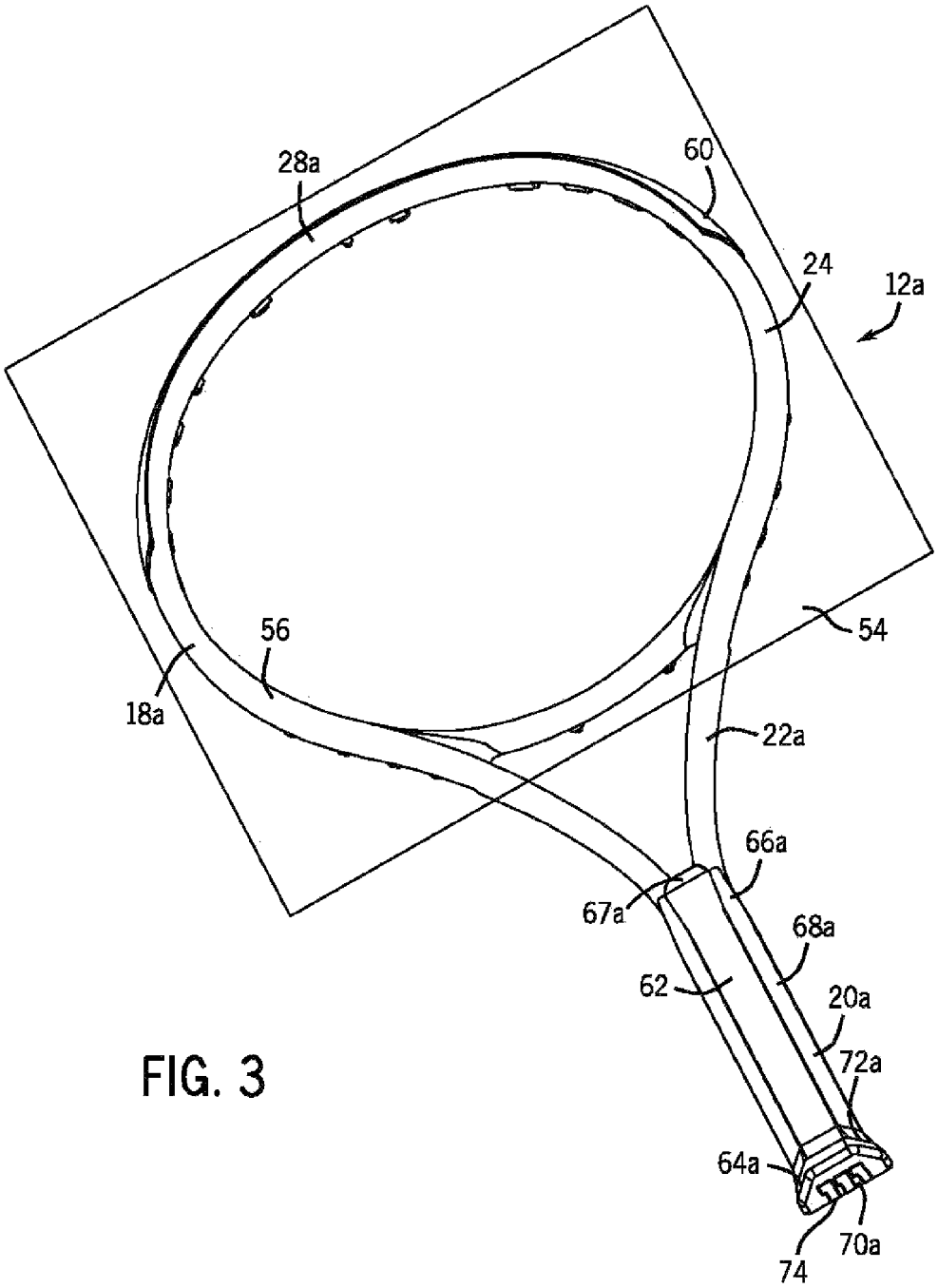
FIG. 3 is a front end perspective view of a first half of a frame of the racquet of FIG. 1.
Figure 4:
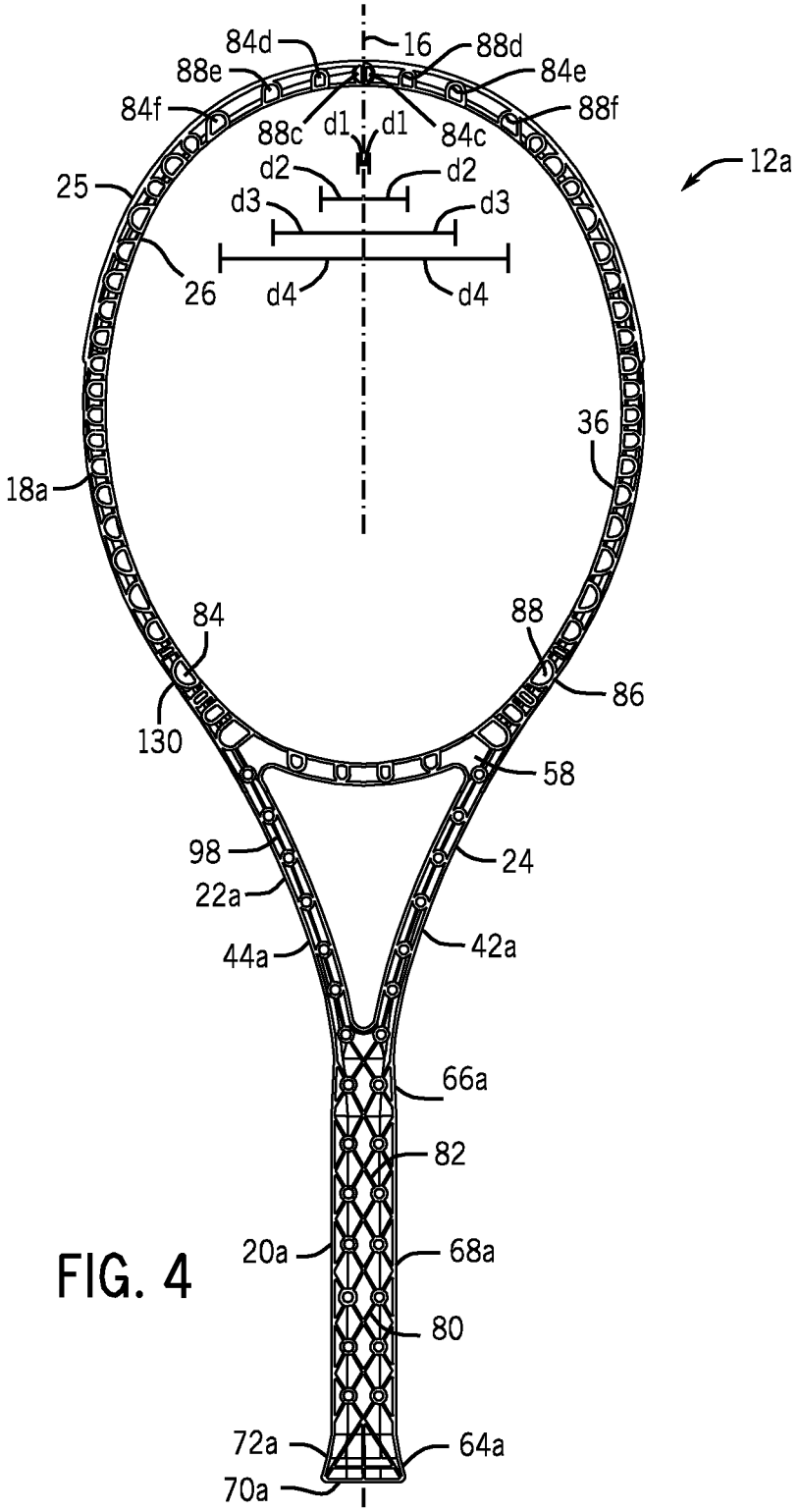
FIG. 4 is a rear view of the first half of the frame of FIG. 3.
Figure 5:
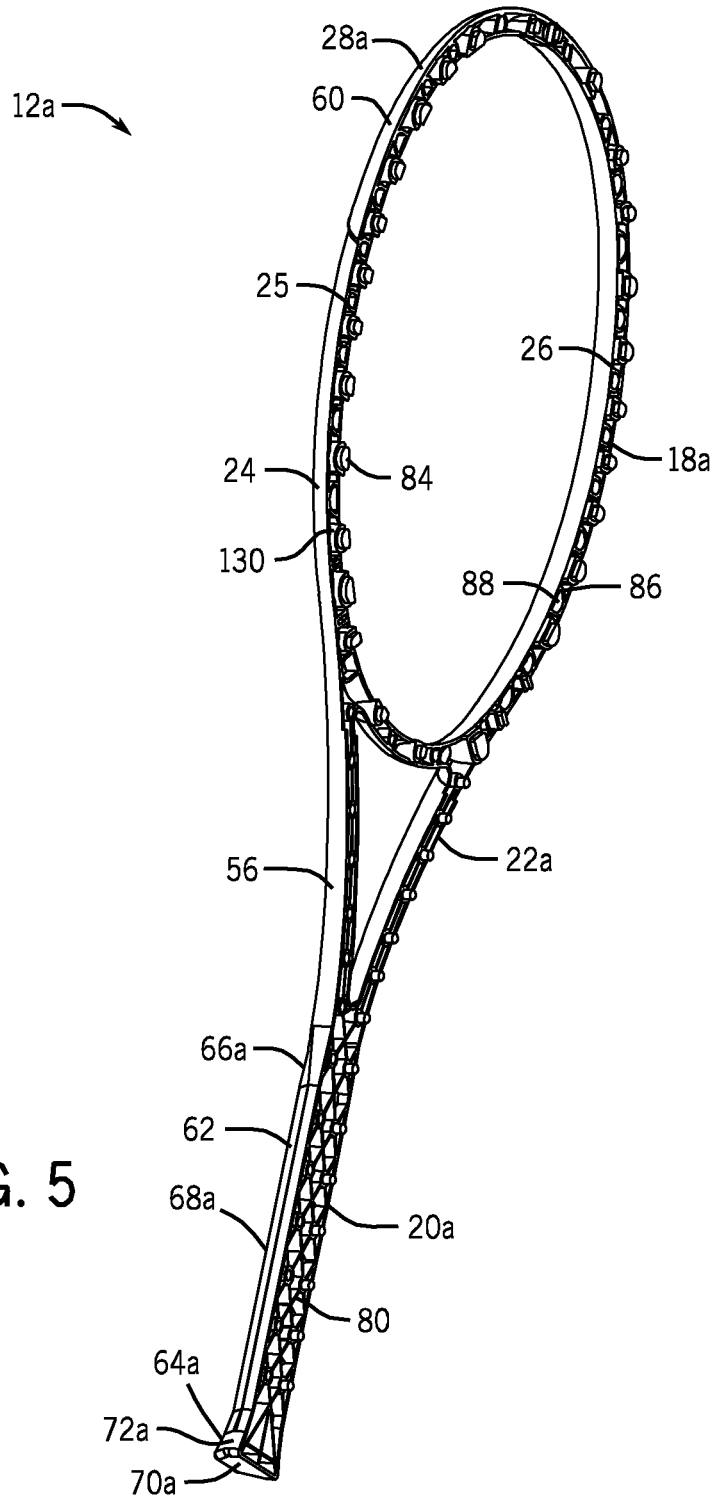
FIG. 5 is a side perspective view of the first half of the frame of FIG. 3.

Referring to FIGS. 3 through 5, the first frame half 12*a* is shown in further detail. The first frame half 12*a* includes a main curved wall 24 that includes an outer surface 56 configured to represent the exterior of the frame 12 of the racquet, and an opposing inner surface 58 (also referred to as a mating surface). The wall thickness of the main curved wall 24 of the first half frame 12*a* is defined by the distance between the outer and inner surfaces 56 and 58. In one preferred embodiment, the wall thickness of the main curved wall 24 is within the range of 0.5 to 3.0 mm. In other alternative embodiments, thicknesses of the main curved wall 24 outside of this range can also be used. Referring to FIGS. 3 through 8, the main curved wall 24 is preferably configured to define first and second peripheral edges 25 and 26. The first and second peripheral edges 25 and 26 preferably extend along the same plane throughout one or more of the first hoop region 18*a*, the first handle region 20*a* and the first throat region 22*a*.

A distal region 28*a* of the first frame half 12*a* can include a raised region 60 that resembles a conventional racquet raised bumper guard. In one preferred embodiment, the raised region 60 is formed by increasing the wall thickness of the main curved wall 24 of the first frame half 12*a* at the distal region 28*a* to produce the raised region 60. In one particularly preferred embodiment, the wall thickness at the distal region 28*a* can be within the range of 2.0 to 3.0 mm, and the wall thickness at the remaining locations of the first half 12*a* can be within the range of 1.0 to 2.5 mm. In other preferred embodiments, other wall thicknesses can be used. In another alternative preferred embodiment, the contours of the mold cavity 104 can provide for the distal region 28*a* to extend outward at the raised region 60 without significantly increasing the wall thickness of the main curved wall 24. The present invention eliminates the need to attach a separate bumper guard to the distal region of the head portion 18 of the racquet 10 making production of the racquet 10 more efficient.

Referring to FIGS. 3 through 5 and 10, the first handle region 20*a* is preferably formed to include a pallet 62. The first handle region 20*a* defines one half of the pallet 62, and the second handle region 12*b* defines the other half The pallet 62 preferably has an octagonal transverse cross-sectional shape when combined with the second handle region 20*b* and viewed with respect to a transverse plane extending perpendicular to the string plane 54. The octagonal shaped pallet 62 simplifies the manufacturing of the racquet 10 by providing surfaces for direct application of the grip 46 without needing to add a separate component (a conventional racquet pallet) to the handle of the racquet. The grip 46 can be readily applied to and/or wrapped about the outer surface 56 of the frame 12 at the handle region 20*a*.

The first handle region 20*a* includes a first proximal end section 64*a*, a distal end section 66*a* and a first central section 68*a* between the first proximal and distal end sections 64*a* and 66*a*. The first handle region 20*a* increases in size as it extends from the first central section 68*a* to the first proximal end section 64*a*. The increased size of the first proximal end section 64*a* when measured with respect to a transverse plane extending perpendicular to the string plane 54 can be found by comparing the transverse cross-sectional area defined by the first proximal end section 64*a* (when combined with a second proximal end section 64*b* (FIG. 9)) to the transverse cross-section area defined by the first distal end section 66*a* (when combined with the second distal end section), or to the transverse cross-section area defined by the first central section 68*a* (when combined with the second central section). The transverse cross-sectional area of the first proximal section 64*a* (when combined with the second proximal end section) is greater than the transverse cross-sectional area of the first distal section 66*a* (when combined with the second distal end section), and the transverse cross-sectional area of the first proximal section 64*a* (when combined with the second proximal end section) is greater than the transverse cross-sectional area of the first central section 68*a* (when combined with the second central section). In one preferred embodiment, the transverse cross-sectional area of the first proximal section 64 can be at least 20 percent greater than the transverse cross-sectional area of the first distal end section 66*a*, or of the first central section 68*a*. In another preferred embodiment, the difference in transverse cross-sectional areas can be at least 30 percent. The first proximal end section 64*a* includes a transversely extending first butt end wall 70*a* that in combination with a second butt end wall 70*b* (FIG. 9) of the second frame half 12*b* substantially closes or covers the proximal end of the racquet frame 12. The increased area or size of the first and second proximal end sections 64*a* and 64*b* along with the first and second butt end walls 70*a* and 70*b* define a butt end region 72 of the racquet 10 that takes the shape of a conventional racquet butt cap. The present invention eliminates the need to attach a separate butt cap to the end of the racquet making production of the racquet more efficient. The butt end region 72 provides all of the desirable attributes of a conventional butt cap such as providing an enlarged region for gripping or indexing of a player's grip, and providing a cover to inhibit debris and/or moisture from entering the racquet frame, but without requiring a separate butt cap to be attached to the end of the racquet. The first and second butt end walls 70*a* and 70*b* can include graphical and/or alpha-numeric indicia 74, such as, for example, a trademark. Alternatively, the indicia 74 can include size information, model information, grip replacement information, supplier information, regulatory information and other forms of indicia. In preferred embodiments, the graphical and/or alpha-numeric indicia 74 can be applied in the form of a decal, a sticker, inks, paint or other secondary marking processes. In an alternative preferred embodiment, the graphical and/or alphanumeric indicia can be formed or shaped as part of the shape of the first and second butt end walls 70*a* and 70*b*. In other words, the indicia 74 can be molded into the shape of the first and/or second butt end walls 70*a* and 70*b*. In alternative preferred embodiments, the frame half 12*a* can be formed without one or more or all of the raised region 60, the pallet configuration, the butt end walls and the enlarged proximal end section.

In one preferred embodiment referring to FIG. 3, the distal end section 66*a* of the first handle region 20*a* is formed in a shape to define a top cap 67*a*. The top cap 67*a* forms a smooth transition between the distal end of the handle region 20*a* and the first throat region 22*a*. The top cap 67*a* and the top cap 67*b* collectively form the top cap 67 of the racquet frame 12.

Figure 10:
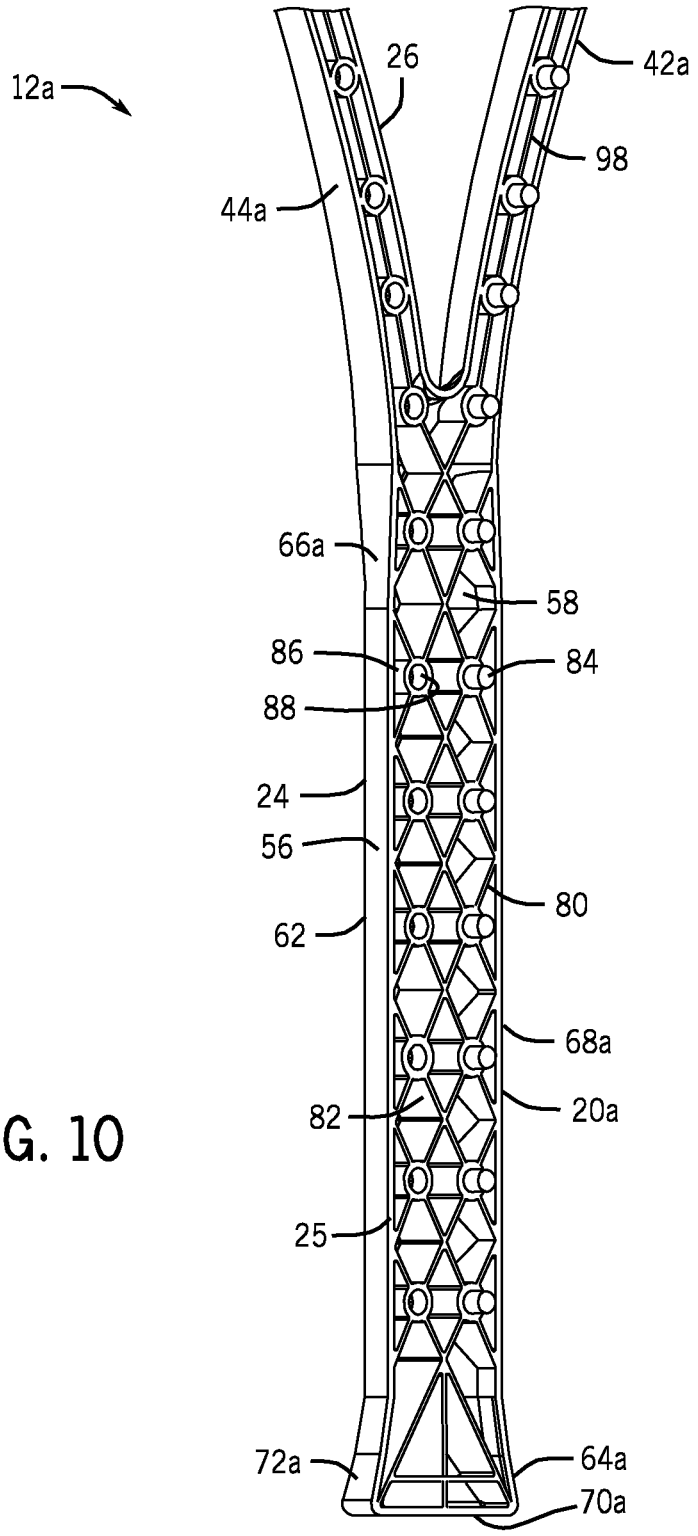
FIG. 10 is a side perspective view of a first handle region of the first half of the frame of FIG. 3

Referring to FIGS. 4 and 10, the first handle region 20*a* preferably includes a plurality of structural support members 80. The structural support members 80 are formed with the first frame half 12*a* during the injection molding process. The structural support members 80 provide additional structural integrity to the first handle region 20*a*. The structural support members 80 preferably can take the form of a plurality, network or matrix of interconnected ribs 82. The thickness, size, shape, orientation, number and spacing of the structural support members 80 can be varied to provide the desired amount of strength, rigidity, stiffness, responsiveness or feel. For example, in one preferred embodiment, the structural support members 80 can be configured to increase the torsional stability or stiffness of the handle region or of the racquet as a whole. In other alternative preferred embodiments, the structural support members can be configured to adjust the longitudinal stiffness, flexibility, durability, reliability, feel, performance, responsiveness or combinations thereof In other preferred embodiments, the structural support members can use other structural configurations, such as, for example, increased wall thickness of the main curved wall 24 at the first handle region 20*a*, and/or adding one or more structural foams within the frame halves.

Figure 6:
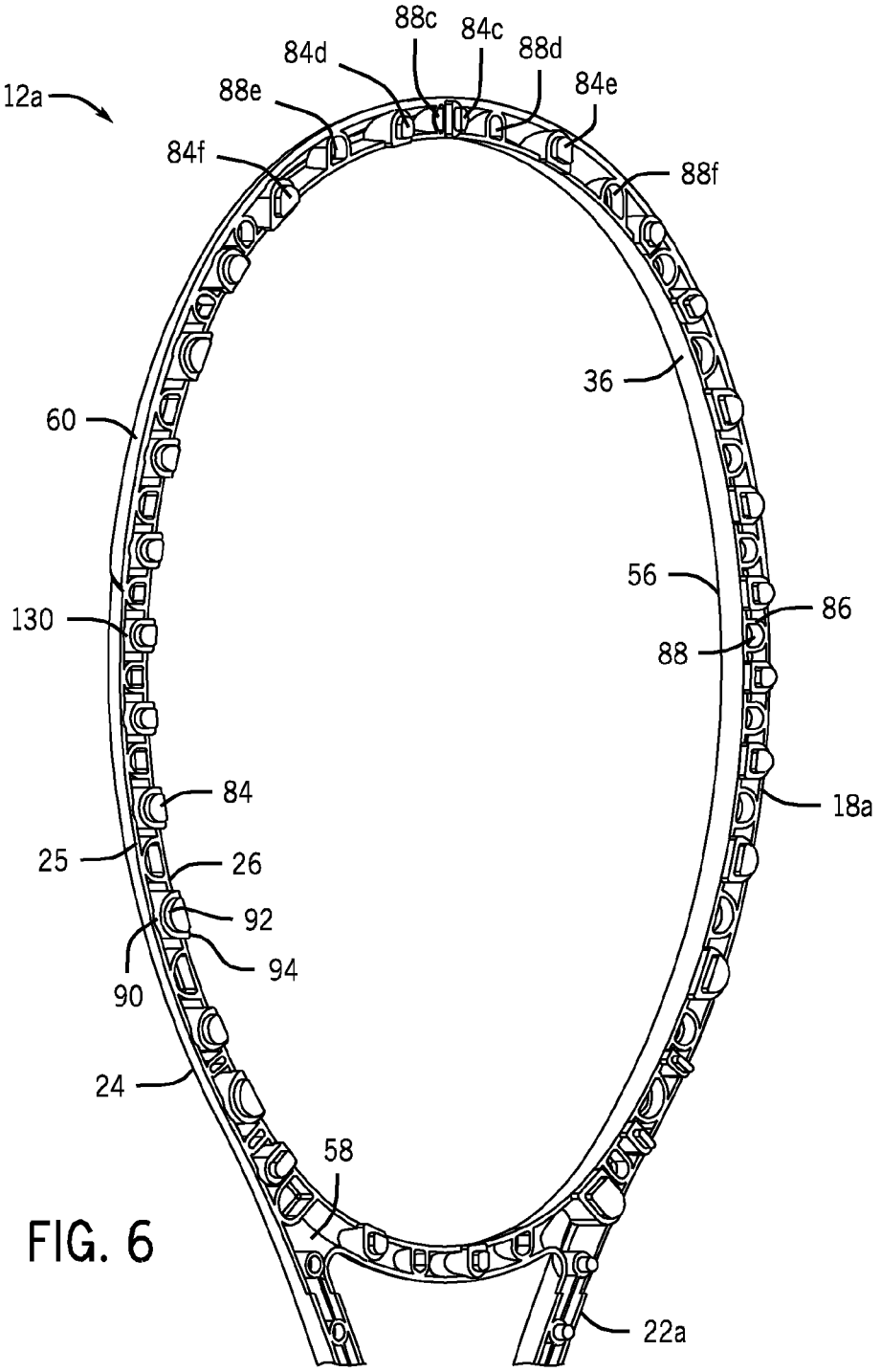
FIG. 6 is a side perspective view of a first hoop region of the first half of the frame of FIG. 3

Referring to FIGS. 4 through 6, 9 and 10, the first frame half 12*a* includes a plurality of projections 84 that extend from the inner surface 58 so as to cross the string plane 54. The plurality of projections 84 also preferably extend beyond the plane defined by the first and second edges 25 and 26. The plane defined by the first and second edges 25 and 26 can be used to define the height of the projection 84 or a height of a portion of the projections. In one particularly preferred embodiment, the string plane 54 is the same plane defined by the first and second edges 25 and 26 for the handle portion 20*a* and for a majority of the throat portion 22*a*. Further, in the particularly preferred embodiment, the plane defined by the first and second edges 25 and 26 at the hoop region 18*a* can be parallel to but be spaced apart from the string plane 54. In other alternative preferred embodiment, the plane defined by the first and second edges 25 and 26 at the hoop region 18*a* can also lie in the same plane as the string plane 54. In other preferred embodiments, the first and second edges of the curved main wall 24 may not lie on a plane, but may be curved, sloped or irregular. A plurality of curved walls 86 extend from the inner surface 58 (or mating surface) to define a plurality of bores 88. In one preferred embodiment, the plurality of projections 84 and the plurality of bores 88 are configured to be corresponding pairs of projections and bores about an axis, such as the longitudinal axis 16. The corresponding pairs of projections and bores correspond for engagement or coupling to another frame half, such as the second frame half 12*b*. Referring to FIGS. 4 and 6, the four projections 84*c*, 84*d*, 84*e* and 84*f* are positioned at first, second, third and fourth distances ($d_1$, $d_2$, $d_3$ and $d_4$) away from the longitudinal axis 16, and the four bores 88*c*, 88*d*, 88*e* and 88*f* are positioned at the same first, second, third and fourth distances ($d_1$, $d_2$, $d_3$ and $d_4$) from the longitudinal axis 16 but in opposite directions. Additionally, the projection 84*c* is shaped to substantially correspond to the shape of the bore 88*c*. Likewise, the shapes of projections 84*d*, 84*e* and 84*f* are shaped to substantially correspond to the shapes of the bores 88*d*, 88*e* and 88*f*, respectively. Accordingly, the projections 84 are preferably sized, positioned and shaped to substantially correspond to the size position and shape of the bores 88 with respect to the longitudinal axis 16.

Figure 7:
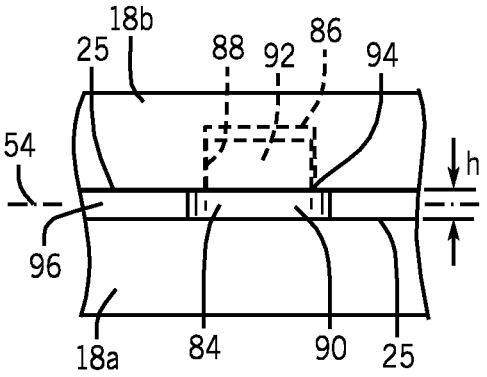
FIG. 7 is a side sectional view of first and second hoop regions of the frame of the racquet of FIG. 1.
Figure 8:
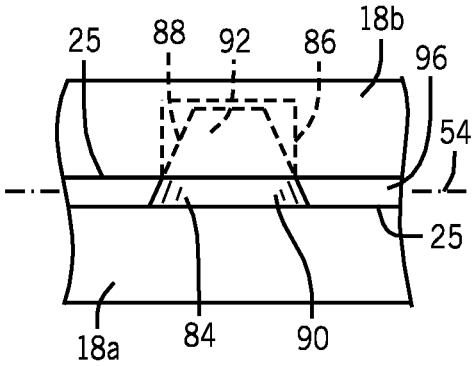
FIG. 8 is a side sectional view of first and second hoop regions of the frame of the racquet in accordance with an alternative preferred embodiment of the present invention.

Referring to FIGS. 6 and 7, at least two of the projections 84 extending from the first hoop region 18*a* can be non-continuous projections. In one preferred embodiment, the non-continuous projection can take the form of a stepped projection having a proximal section 90 and a distal section 92. The proximal section 90 and the distal section 92 each have a transverse cross-sectional area measured with respect to the string plane 54. The transverse cross-sectional area of the proximal section 90 is preferably greater than the transverse cross-sectional area of the distal section 92. The transition between the proximal section 90 and the distal section 92 can be stepped to form a projection shoulder 94 on the stepped projection 84. The bores 88 are configured to correspond to the non-continuous projections 84 are preferably sized to receive only a portion of or all of the distal section 92 and not the proximal section 90 of the stepped projection 84. Referring to FIG. 8, in another preferred embodiment, the non-continuous projection 84 can take a different shape. The transition from the proximal section to the distal section can be gradual, frusto-conical, and non-stepped so as not to define a projection shoulder on the projection. The shape of the frusto-conical projection corresponds to the size of the end of the bore 88. The distal section of the projection 84 is received by the bore 88 but as the diameter of the frusto-conical projection 84 matches the size of the end of the bore 88, the engagement between the projection 84 and the bore 88 stops. In other alternative preferred embodiments, other shapes for the projections and the bores are contemplated to provide the desired amount of engagement.

Figure 9:
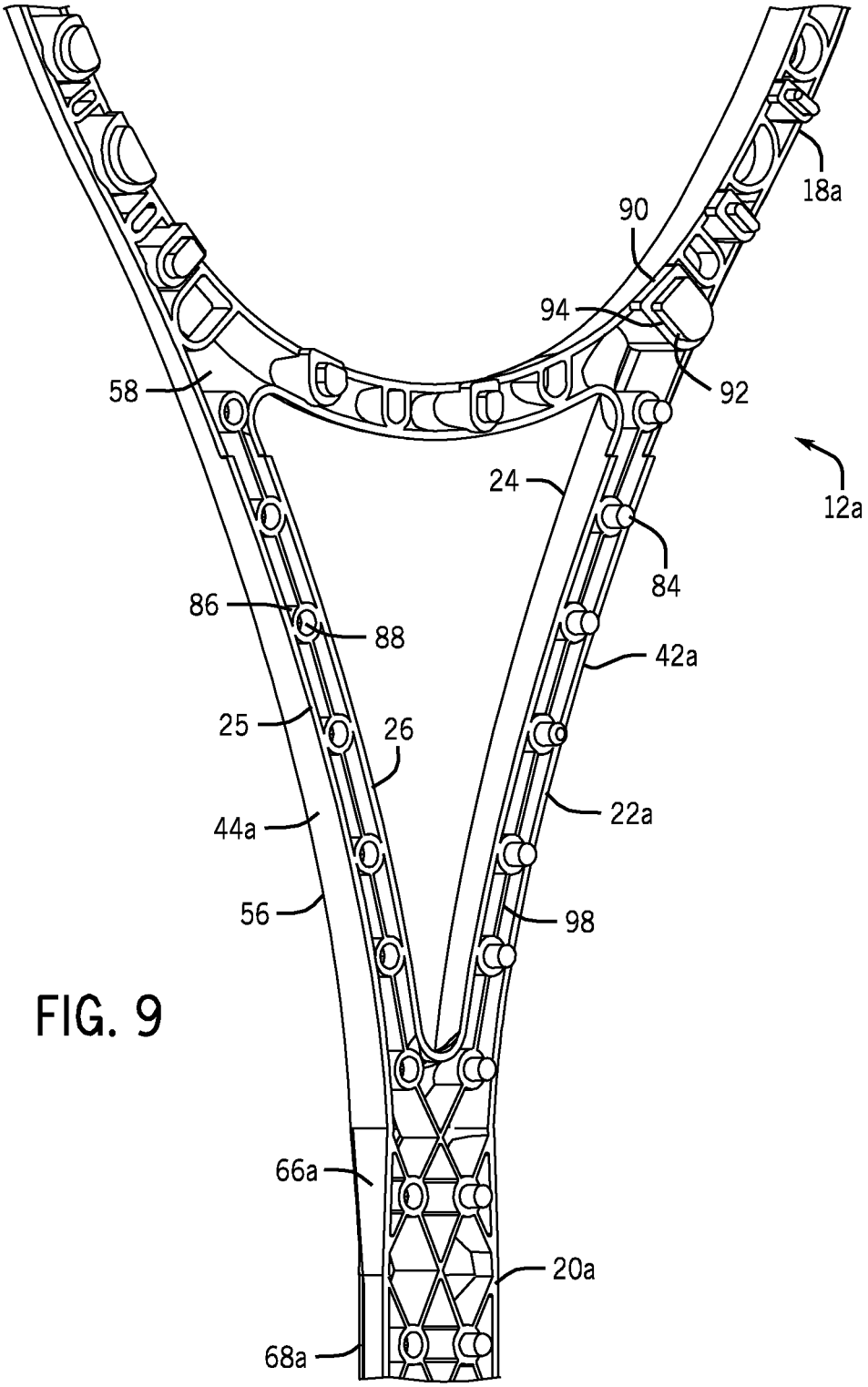
FIG. 9 is a side perspective view of a first throat region of the first half of the frame of FIG. 3

Referring to FIGS. 4, 6, 9 and 10, the shape and spacing of the projections 84 and the corresponding bores 88 can vary throughout the first frame half 12*a*, and within one or more of the first hoop region 18*a*, the first throat region 22*a* and the first handle region 20*a*. Referring to FIGS. 4 and 9, the projections 84 and bores 88 of on first and second throat tubes 42*a* and 44*a* of the throat region 22*a* of the first frame half 12*a* are primarily configured for facilitating alignment and coupling to a corresponding frame half (such as the second frame half 12*b*). The projections 84 and bores 88 are preferably corresponding about or with respect to the longitudinal axis 16. The projections 84 of the first throat tube 42*a* are positioned along one side of the longitudinal axis 16 and the bores of the second throat tube 44*a* are position along the other side of the axis 16. Further, the distance from the axis 16 for each corresponding pair of projections 84 and bores 88, and the spacing of one corresponding pair to the next, is also substantially the same. In alternative preferred embodiments, the projections 84 and bores 88 in the throat region 22*a* can be staggered or randomly arranged so that some projections, and some bores, are on the first throat tube 42*a* and others are on the second throat tube 44*b* provided that the corresponding nature of the projections and bores remains. Additionally, in other alternative embodiments, the distance that each corresponding pair of projections and bores is from the longitudinal axis 16, and the spacing between adjacent corresponding pairs of projections and bores, can be varied from one corresponding pair to another corresponding pair. The first and second throat tubes 42*a* and 44*a* also include a support rib 98 for increasing the structural integrity of the first and second throat tubes 42*a* and 44*a*. The support rib 98 is formed with the first frame half 12*a*. In other alternative preferred embodiments, the thickness, height, shape, number, orientation and spacing of the support rib can be varied to meet a particular application, player need or other design requirement. In one preferred embodiment, the first and second edges 25 and 26 of the main curved wall 24 over a majority of the first and second throat tubes 42*a* and 44*a* extend to lie in a common plane, and the common plane is the same plane as the string plane 54. In other alternative preferred embodiments, the first and second edges 25 and 26 of the first and second throat tubes 42*a* and 44*a* can lie in a common plane that is parallel to but spaced apart from the string plane 54.

Referring to FIGS. 4 and 10, the projections 84 and bores 88 of the handle portion 20*a* are primarily configured for facilitating alignment and coupling to a corresponding frame half (such as the second frame half 12*b*). The projections 84 and bores 88 are preferably corresponding about or with respect to the longitudinal axis 16. The projections 84 of the handle region 20*a* are positioned along one side of the longitudinal axis 16 and the bores alone the other side of the axis 16. Further, the distance from the axis 16 for each corresponding pair of projections 84 and bores 88 is also substantially the same. In alternative preferred embodiments, the projections 84 and bores 88 in the handle region 20*a* can be staggered or randomly arranged so that some projections are on one side of the axis 16 and others are on the other side provided that the corresponding nature of the projections and bores remains. Additionally, in other alternative embodiments, the distance that each corresponding pair of projections and bores is from the longitudinal axis 16 can be varied from one corresponding pair to another corresponding pair. In one preferred embodiment, the first edges 25 of the main curved wall 24 over the first handle region 20*a* extend to lie in a common plane, and the common plane is the same plane as the string plane 54. In other alternative preferred embodiments, the first and second edges 25 and 26 of the first handle region 20*a* can lie in a common plane that is parallel to but spaced apart from the string plane 54.

Figure 11:
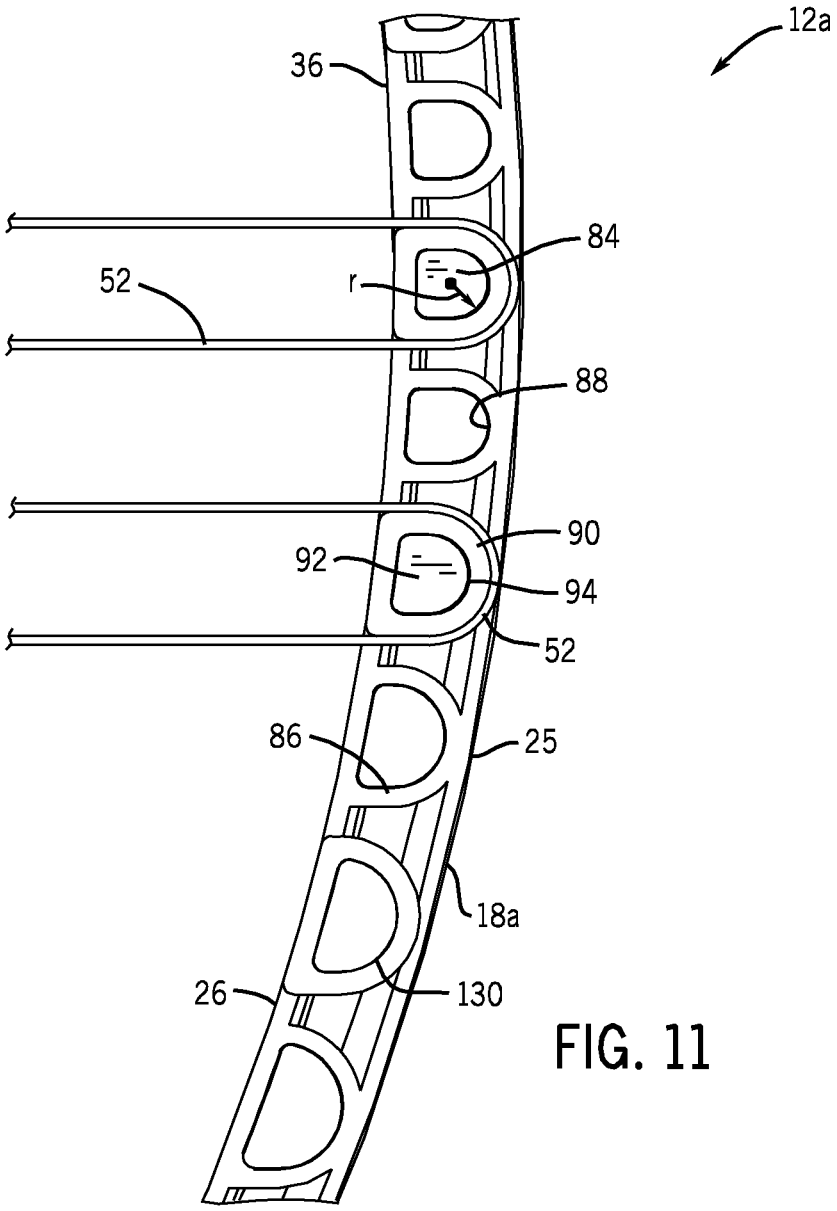
FIG. 11 is a rear view of a portion of the hoop region of the first half of the frame of FIG. 3 showing racquet string engaging the hoop region.

Referring to FIGS. 4, 6 and 11, the size and shape of the projections 84 and bores 88 of the first hoop region 18*a* vary about the periphery of the hoop 36. In a preferred embodiment, most of the projections 84 of the hoop region 18*a* are stepped projections. The shape of projection 84 and of the proximal section 90 of the projection 84 can include a curved bearing surface 130. The curved bearing surface 130 is preferably configured to extend about the outer periphery of the respective projection 84 so that the curved bearing surface 130 provides surface for supporting and engaging a portion of the racquet string bed 14. In particular, as shown in FIG. 11, the curved bearing surface 130 can support and direct the racquet string as it extends from one cross string segment 52 to another cross string segment 52. The projections 84 and bores 88 of the first hoop region 18*a* can be sized and shaped into a plurality of different subsets of projections and corresponding bores. The projection 84*c* and the bore 88*c* can represent a first subset, and the projections 84*d*, 84*e* and 84*f* and bores 88*d*, 88*e* and 88*f* can define second, third and fourth subsets of projections and bores. Additional subsets of projections and bores are also present on the first hoop region 18*a* as shown in FIGS. 4 and 6. The number of projections and bores in a single subset can be one projection and one bore, or any number of projection and bores. The curved bearing surface 130 of the proximal section 90 preferably extends over at least 120 degrees of curvature. In a more preferred embodiment, the curved bearing surface 130 extends over at least 180 degrees of curvature. The curved bearing surface 130 preferably generally defines a circular arc having a radius of curvature, r, over a predetermine number of degrees of curvature. The radius r of the circular arc (or the radius of curvature) can vary from one subset of projections to another subset of projections. The radius r of curvature preferably is within a range of 2 mm to 12 mm. The subsets of projections preferably include at least two different radii r of curvature. The set of projections can include at least first and second projections (or at least two subsets of projections) having at least first and second radii of curvature, respectively. In one preferred embodiment, the first radius of curvature is at least 0.5 mm greater than the second radius of curvature. In another preferred embodiment, the set of projections can include at least first, second and third projections having at least first, second and third radii of curvature, respectively. The first, second and third radii of curvature are different from one another. In one particularly preferred embodiment, each of the first, second and third radii of curvature vary in size by at least 0.5 mm. In another preferred embodiment, the curved bearing surfaces 130 of a first subset of projections 84 have a radius of curvature r that falls within a first range of 2 mm to less than or equal to 6 mm, and the curved bearing surfaces 130 of a second subset of projections 84 have a radius of curvature r that falls within the range of greater than 6 mm to 12 mm. In other preferred embodiments, the number of different radii of curvatures r or ranges of radii of curvature can be three or more. The bores 88 corresponding to the projections 84 are sized and shaped accordingly to engage each other.

The projections 84 are preferably circular, semi-circular or form only portion of a circular arc. In one preferred embodiment, at least two of the projections 84 can have a generally D-shaped transverse cross-sectional area with respect to the string plane 54. In another preferred embodiments, a majority of the projections 84 have a generally D-shaped transverse cross sectional area. In other preferred embodiments, the projections can have transverse cross sectional shapes with respect to the string plane 54 can take one or more of the following shapes or a combination thereof, circular, semi-circular, elliptical, semi-elliptical, U-shaped, C-shaped, other curved shapes, rectangular, triangular, square, other polygonal shapes, and irregular shapes. When the projection has a shape that is not circular, the string is directed about the periphery of the curved surface and not about a radius of a circle. The size of the radius of curvature of the curved bearing surface 130 of the projection 84, or the distance covered by the curved bearing surfaces that do not include at least part of a circular shape, can be used to define the spacing between adjacent main string segments 52 or adjacent cross string segments 50 of the string bed 14. The spacing between the projections 84 and the bores 88 can also be varied about the periphery of the hoop region 18*a* to provide the desired pattern and spacing of the string bed 14. The size of the radii of curvature or the curved surface of the curved bearing surfaces 130 of the projections configured to support string segments extending through or near the center of the hoop 36 may be smaller or the projections may be positioned closer together than the projection 84 at positions away from the center of the hoop 36. In other preferred embodiments, other radii of curvature and spacing apart of the curved bearing surfaces of the projections about the periphery of the first hoop region can be used to accommodate any desired string bed pattern. The projections 84 that are not also configured for supporting a main or cross string segment 50 or 52 can have any shape, including non-curved shapes. Accordingly, in one preferred embodiment, the projections 84 of the hoop region 12*a* can have a curved bearing surface, and the projections 84 of the handle regions 20*a* and/or the throat region 22*a* can take any shape.

Figure 13:
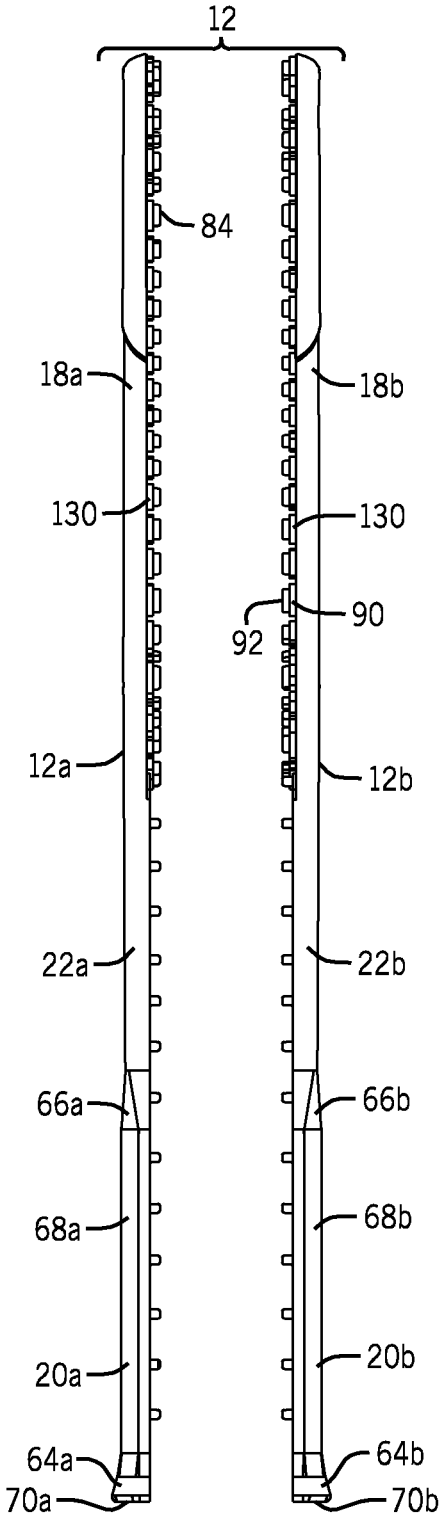
FIG. 13 is a side view of the first and second halves of the frame of the racquet of FIG. 1 shown spaced apart and facing each other.
Figure 14:
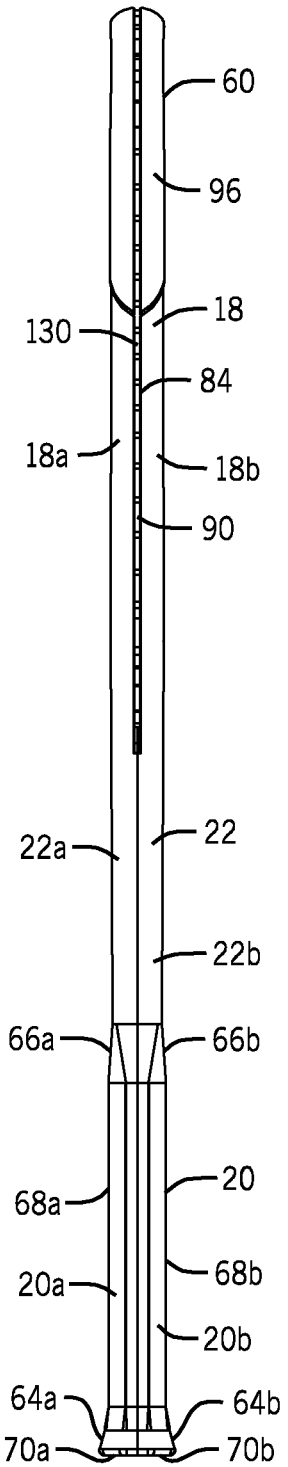
FIG. 14 is a side view of first and second halves of the frame of the racquet of FIG. 1.

Referring to FIGS. 7 and 12 through 14, the first and second frame halves 12*a* and 12*b* are preferably identical. The frame halves 12*a* and 12*b* can be produced separately from the same injection molding apparatus 100. Referring to FIGS. 12 and 13, when the first frame half 12*a* is positioned with the inner surface 58 of the main curved wall 24 facing the inner curved surface 58 of the second frame half 12*b*, the corresponding projections 84 and bores 88 align with each other enabling the first frame half 12*a* to matably engage to second half frame 12*b*, as shown in FIG. 14. Essentially, the rotation of the second frame half 12*b* 180 degrees about the longitudinal axis 16 places the projections 84 and bores 88 of the first frame half 12*a* in alignment with the projections 84 and bores 88 of the second frame half enabling the two frame haves to readily engage each other. The first frame half 12*a* can be coupled to the second frame half 12*b* through the engagement of the corresponding projections and bores and through a cyanoacrylate adhesive. In alternative embodiments, the first and second frame halves 12*a* and 12*b* can be coupled together through other adhesives, thermal bonding, chemical bonding, and combinations thereof.

Referring to FIGS. 7 and 12 through 14, the stepped or non-continuous projections 84 of the first and second hoop regions 18*a* and 18*b* are configured to engage each other. The shoulder 94 of the stepped projections 84 engage the ends of the curved walls 86 defining the bores 88 to allow for only the distal end section 92 to be received within the bore 88. In one preferred embodiment, as shown in FIGS. 7 and 14, the first hoop region 18*a* is spaced apart from the second hoop region 18*b*, while the first and second handle regions 20*a* and 20*b* and substantially all of the first and second throat regions 22*a* and 22*b* are not spaced apart from each other. Accordingly, there is no channel, groove or holes formed at the coupling location of the first and second handle regions 20*a* and 20*b*, and no channel, groove or holes formed at the coupling location about most of the first and second throat regions 22*a* and 22*b*. A slight depression or channel may be formed by the coupling of the first and second handle regions 20*a* and 20*b* and/or the first and second throat regions 22*a* and 22*b*, but the depression or channel would not exceed 0.5 mm in depth under one preferred embodiment. The term "spaced apart" in this context refers to the separation of the first edges 25 and the second edges 26 of the main curved wall 24 of the first and second frame halves 12*a* and 12*b*, and can be defined by a projected height h of the proximal section 90 of the stepped projections 84. The spacing apart of only the first and second hoop regions 18*a* and 18*b* provides the spacing and defines openings where they are desired and eliminates openings where they are not needed or desired (e.g. on the handle portion 20 or the throat portion 22 of the racquet frame 12). The projected height h can be measured as the distance between the first edge 25 of the first hoop region 18*a* to the first edge 25 of the second hoop region 18*b*. Alternatively, the projected height h can be measured from a plane defined by the first and second edges 25 and 26 of either the first or the second hoop region 18*a* and 18*b*, wherein the plane is measured with respect to the string plane 54. The plane is preferably parallel to and spaced apart from the string plane 54. The plane defines one reference point and the other is a plane defined by the shoulder 94 of the stepped projection 84. In another preferred embodiment, the projected height, h, can be measured as the height of the proximal section 90 of the stepped projection 84 measured in a direction that is perpendicular to the string plane 54. In one preferred embodiment, the projected height h is within the range of 1.5 mm to 12 mm. In a particularly preferred embodiment the projected height h is within the range of 2 to 6 mm.

Referring to FIGS. 7 and 14, the spacing apart of the hoop regions 18*a* and 18*b* and the proximal sections 90 of the stepped projections 84 define a plurality of openings 96 (or through hoop region openings). The spacing apart the first and second frame halves 12*a* and 12*b*, and/or one or more of the hoop regions 18*a* and 18*b*, the handle regions 20*a* and 20*b* and the throat regions 22*a* and 22*b* can form a channel between the first and second halves or regions. The plurality of openings 96 can be used to accommodate racquet string to form the string bed 14. The curved bearing surfaces 130 of the proximal sections 90 of the stepped projections 84 provide support for the racquet string. The main and cross string segments 50 and 52 of the string bed can be supported by the curved bearing surfaces 130 to allow for formation of the string bed 14. The present invention eliminates the need to drill, punch or otherwise make string holes through the first and second hoop regions 18*a* and 18*b*. The present invention also makes the use of grommet strips unnecessary. Accordingly, the present design offers another benefit of eliminating the need for grommet strips and eliminating the need to drill or form string holes into a head portion of a racquet. The drilling or forming of string holes within a racquet frame can introduce stress risers at or near the string holes and can lead to premature failure or reduced durability of the racquet frame. In an alternative preferred embodiment, one or both of the handle regions 20*a* and 20*b* and the throat regions 22*a* and 22*b* can be spaced apart from each other in a manner similar to the spacing apart of the hoop regions 18*a* and 18*b*. In other preferred embodiment, the bores can be defined by openings in a continuous section of material such as a structural foam or a portion of the wall thickness of the frame half. In other preferred embodiments, the projections and bores can be replaced by a hook and loop configuration, a tongue and groove configuration, or other fastening mechanism.

Figure 15A:
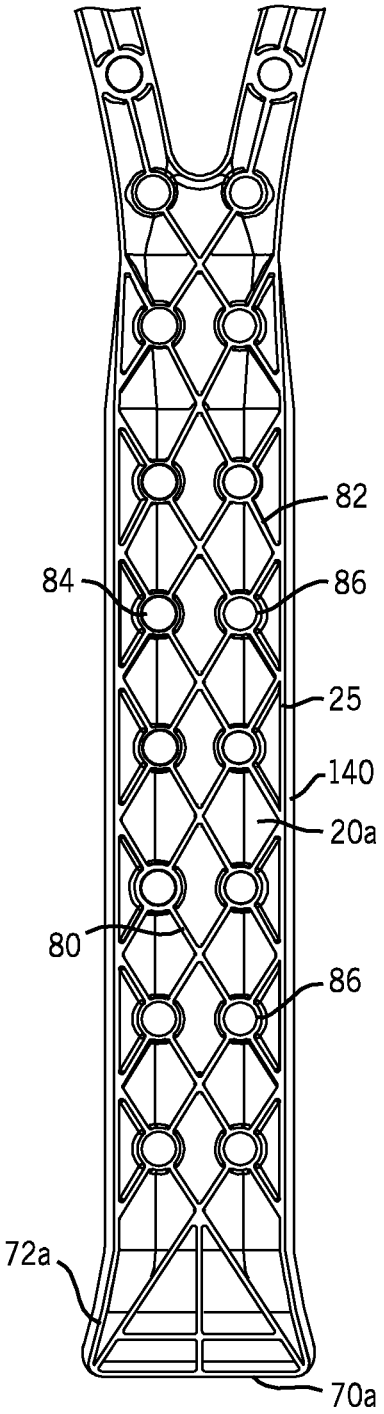
FIGS. 15*a* and 15*b* are longitudinal cross-sectional views of the handle region of the frame of the racquet in accordance with two alternative preferred embodiments of the present invention.

Referring to FIG. 15*a*, in an alternative preferred embodiment, the handle regions 20*a* and 20*b* can be formed of first and second thermoplastic materials. The first thermoplastic material is used to form the frame including the base layer of the handle region 20*a*. A second thermoplastic layer 140 can be molded over the base layer of the handle region 20*a* to form an overmolded handle. The first thermoplastic material has a durometer value measured on the Shore A or Shore D hardness scale that is greater than the durometer value of the second thermoplastic material of the second thermoplastic layer 140 measured on the Shore A or Shore D hardness scale. In other words, the second thermoplastic layer 140 formed of the second thermoplastic material is softer to the touch than the first thermoplastic material of the frame 12. In this configuration, the softer overmolded second thermoplastic layer 140 can be used in place of a conventional grip. Alternatively, a grip (such as the grip 46 of FIG. 1) can be formed over the second thermoplastic layer 140 to provide a softer and more dampened feel to the completed racquet.

Figure 15B:
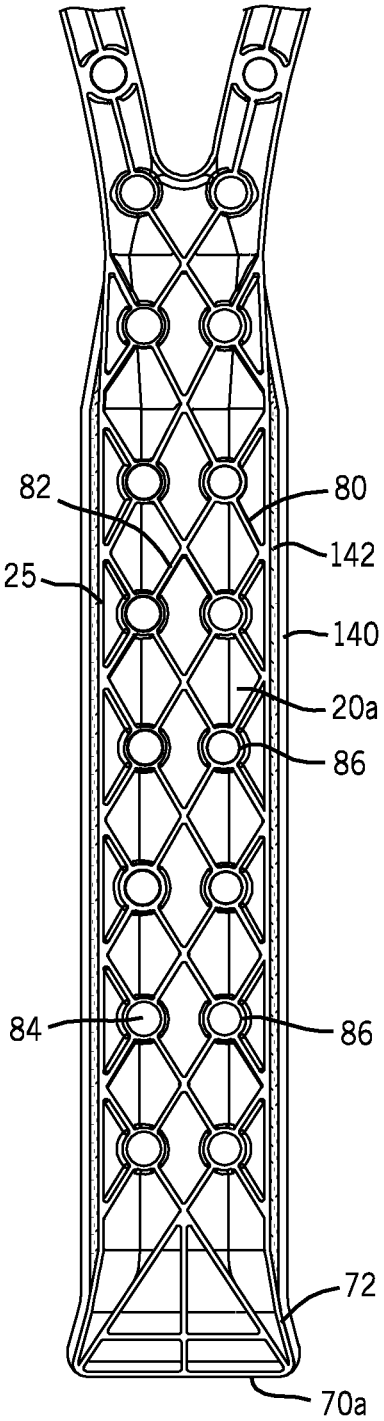

Referring to FIG. 15*b*, in another alternative preferred embodiment, the handle regions 20*a* and 20*b* can be formed first, second and third thermoplastic materials. The first thermoplastic material is used to form the frame including the base layer of the handle region 20*a*. A third thermoplastic material that includes a foaming agent is formed over the base layer to form a cushion layer 142. The second thermoplastic layer 140 is can then be molded over the cushion layer 142 and the base layer of the handle region 20*a* to form a cushioned overmolded handle. The first thermoplastic material has a durometer value measured on the Shore A or Shore D hardness scale that is greater than the durometer value of the second thermoplastic material measured on the Shore A or Shore D hardness scale. Additionally, the first and second thermoplastic materials can have durometer values that are greater (or harder) than the durometer value of the third material.

Figure 16:
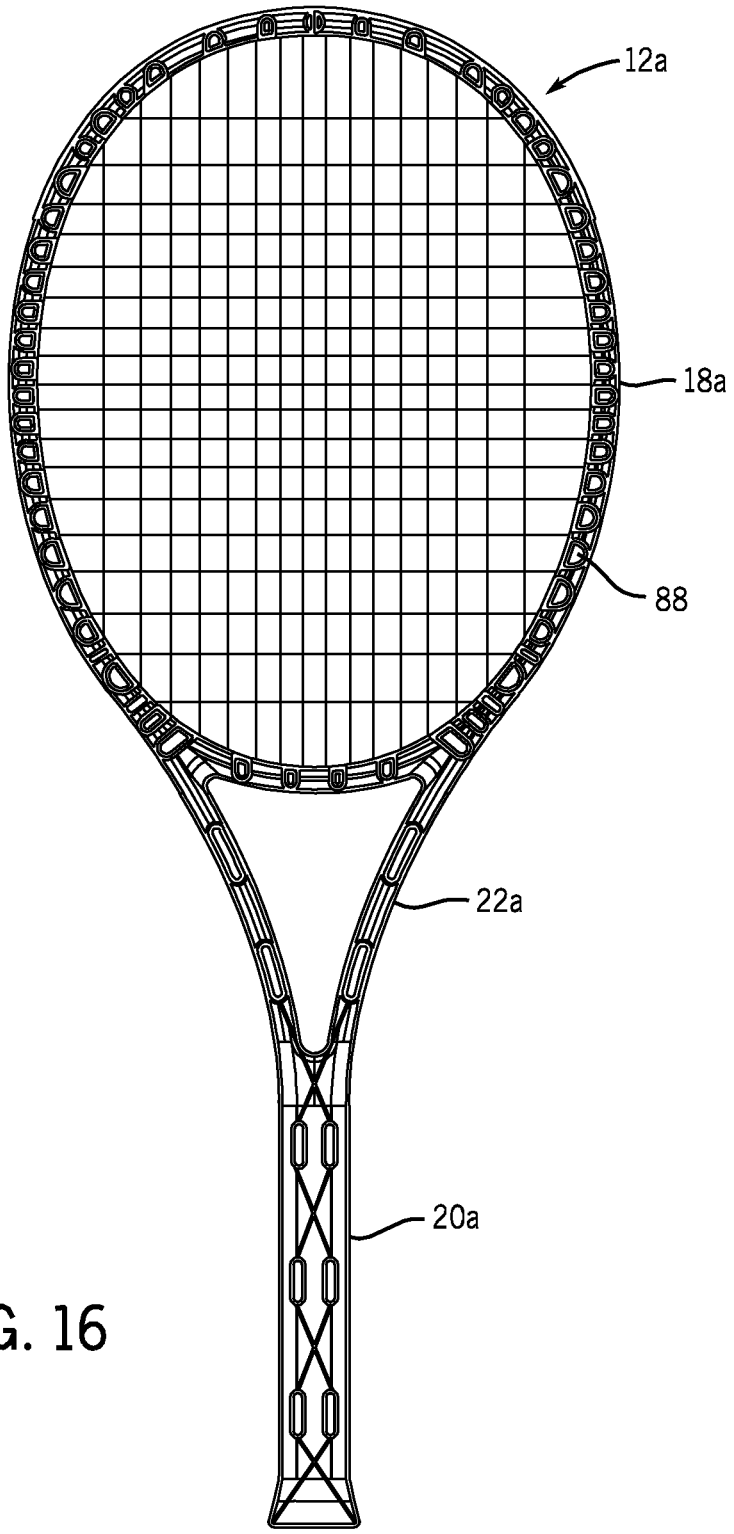
FIGS. 16 and 17 are rear views of a first half of a frame of a racquet in accordance with two other alternative preferred embodiments of the present invention.
Figure 17:
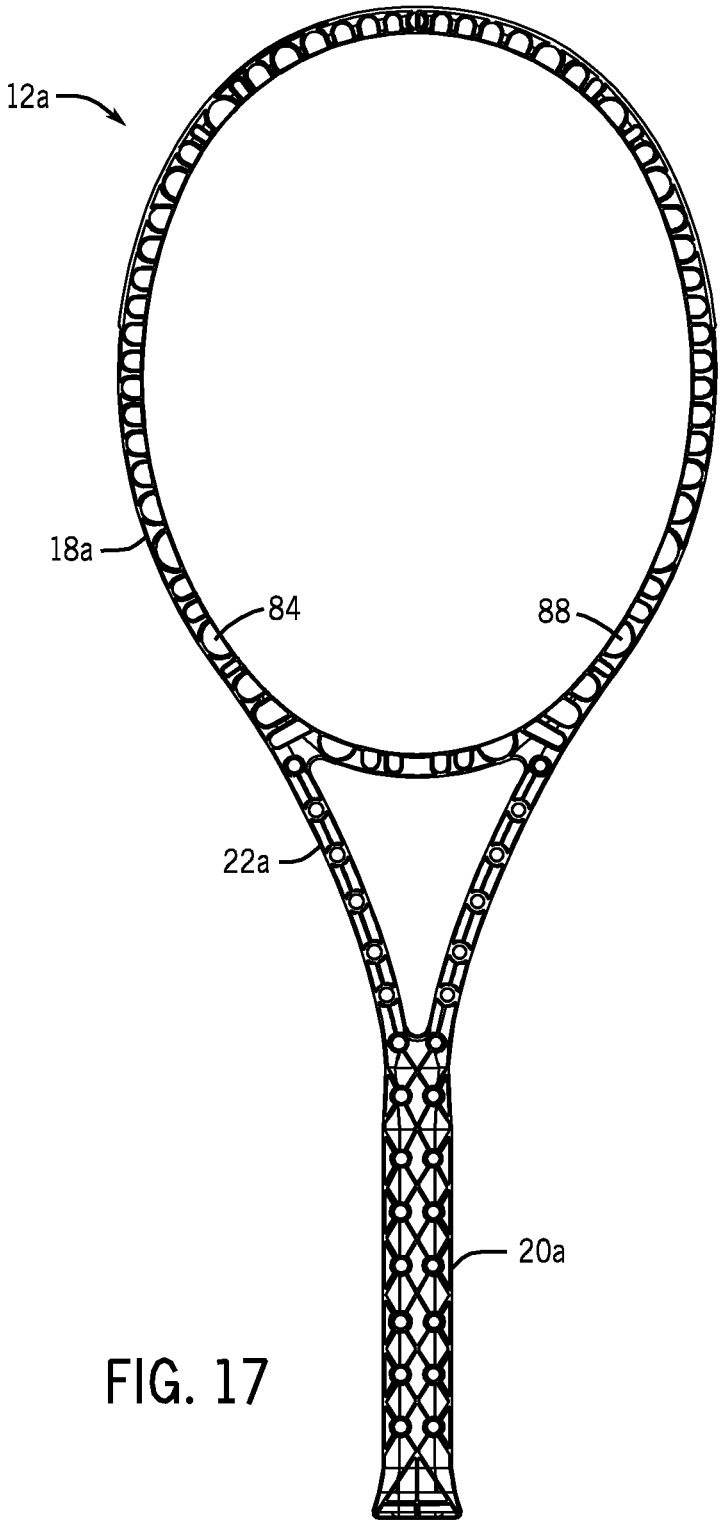

Referring to FIGS. 16 and 17, alternative preferred embodiments of the first frame halve 12*a* are shown. The first frame half 12*a* of FIG. 16 and of FIG. 17 include projections 84 and bores 88 having different shapes and different spacing. The present invention contemplates the use of different quantities of projections and bores, different shapes and sizes of projections and bores and different spacing of the projections and bores. The size, shape and spacing of the bores and the projections can be varied to provide different stringing patterns to the head portion of the racquet, or to provide a slightly different feel. The different configurations can also result in a slight variation in weight, rigidity, torsional stability, or other characteristic.

Figure 18:
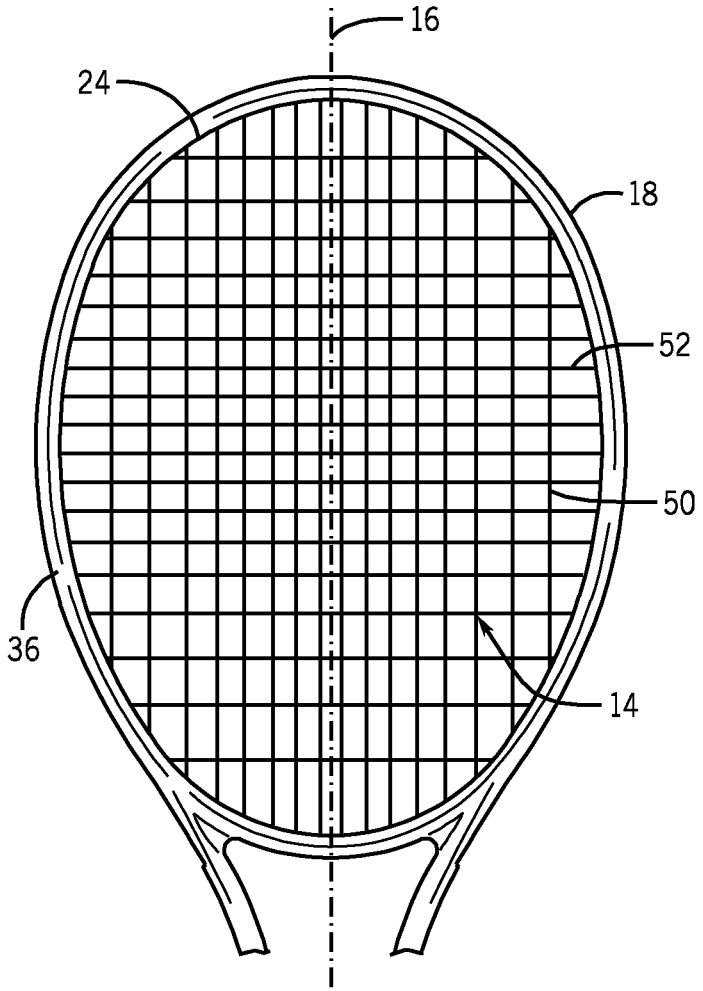
FIG. 18 is a front view of a hoop region of a racquet in accordance with another alternative preferred embodiment of the present invention.

Referring to FIG. 18, the head portion 18 of a racquet is shown. The head portion is formed of first and second hoop regions 18*a* and 18*b* as a thermoplastic racquet produced in an injection molding operation. In one preferred embodiment, the string bed 14 of the racquet of FIG. 16 is a pattern of crossed strings that are bonded where they cross, and not alternately interlaced like a conventional string bed. The non-interlaced string bed is produced as a one piece structure in an injection molding apparatus. The injection molded string bed can be produced with one of the first or second hoop regions 18*a* and 18*b*, or produced as a one piece separate structure that is connected to one or both of the first and second hoop regions 18*a* and 18*b*. The racquet string is formed of a high tensile strength, flexible material. In preferred embodiments, the racquet string can be formed of a polyester material, a nylon, a natural gut material and/or a synthetic gut material. In an alternative preferred embodiment, the main string segments or the cross-string segments can be formed as injection molded thermoplastic material and the other of the main string segment or the cross string segments can be interlaced with the molded string segments.

The present invention provides a cost effective manner of producing a sports racquet having exceptional performance, reliability and durability. The present invention provides greater design flexibility enabling racquets to be produced to meet different applications, and characteristics desired by players of various skill levels, needs and budgets. Sports racquets built in accordance with the present invention can be produced quickly and cost effectively without negatively effecting performance, feel, durability or playability. The sports racquets built in accordance with the present invention do not require a number of extra components in order to be fully assembled. A separate butt cap, a separate pallet, a separate bumper guard, and one or more grommet strips can all be eliminated under embodiments of the present invention. Additionally, the need to perform extra machining operations to drill string holes into the racquet frame can also be eliminated. The present invention provides these advantages without radically departing from the look and design from traditional sport racquet designs.

While the preferred embodiments of the invention have been illustrated and described, it will be appreciated that various changes can be made therein without departing from the spirit and scope of the invention. For example, each of the first and second frame halves can be formed as two or more separate injection molded pieces from an injection molding operation that are coupled together to form the completed racquet. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A sports racquet extending along a longitudinal axis and configured for supporting a quantity of racquet string generally about a string plane, the racquet comprising:

a frame formed of a thermoplastic material, the frame including a head portion and a handle portion, the head portion being formed of first and second hoop regions, each of the first and second hoop regions including a main curved wall defining first and second peripheral edges, the first and second peripheral edges of the hoop region defining a peripheral edge plane, at least one of the first and second hoop regions including a first set of projections extending from one of the first and second hoop regions across the string plane and engaging the other of the first and second hoop regions such that the first set of projections extend at least from the peripheral edge plane of the first hoop region to the peripheral edge plane of the second hoop region, the first set of projections spacing apart the first and second hoop regions by a first predetermined dimension to define a plurality of through-hoop region openings, the first predetermined dimension being substantially the same as the distance between the peripheral edge planes of the first and second hoop regions, the handle portion being formed of first and second handle regions directly coupled together without defining one of a plurality of handle openings.

2. The sports racquet of claim 1, wherein the thermoplastic material includes a thermoplastic resin and a plurality of fiber segments.

3. The sports racquet of claim 2, wherein the thermoplastic resin is formed of a material selected from the group consisting of nylon, polystyrene, polycarbonate, polyphenylene sulfide, polyether ether ketone, polytetrafluoroethylene, acrylonitrile-butadiene-styrene, acetal, phenylene oxide, vinyl, polyvinyl chloride, polyamide, polyurethane, polyethylene terephthalate, polypropylene, other polyethylenes, and combinations thereof.

4. The sports racquet of claim 2, wherein the fibers are formed of a material selected from the group consisting of carbon, glass, graphite, boron, basalt, carrot, aramid, Kevlar®, Spectra®, poly-para-phenylene-2, 6-benzobisoxazole (PBO), hemp, flax, and combinations thereof.

5. The sports racquet of claim 2, wherein the thermoplastic material used to form the frame has a durometer value within the range of 20 on the Shore A hardness scale to 40 on the Shore D hardness scale.

6. The sports racquet of claim 2 wherein the thermoplastic material forms a first thermoplastic layer of the first and second handle regions, wherein a second thermoplastic layer formed of a second thermoplastic material is molded over the first thermoplastic layer, and wherein the thermoplastic material of the first thermoplastic layer has a durometer value measured on the Shore A or Shore D hardness scale that is greater than the durometer value of the second thermoplastic material measured on the Shore A or Shore D hardness scale.

7. The sports racquet of claim 1, wherein the first predetermined dimension measured in a direction orthogonal to the string plane is within the range of 2 to 12 mm.

8. The sports racquet of claim 1, wherein the frame further includes a throat region, and wherein the throat portion is formed of first and second throat regions directly coupled together without defining one of a plurality of throat openings.

9. The sports racquet of claim 1, wherein the first and second hoop regions define first and second hoops, respectively.

10. The sports racquet of claim 1 wherein the frame is formed of first and second frame halves, wherein the first and second frame halves include the first and second hoop regions and the first and second handle regions, respectively, and wherein the first frame halves are substantially identical to each other.

11. The sports racquet of claim 10, wherein the first and second halves are coupled together by an adhesive, thermal bonding, chemical bonding, thermal welding, sonic welding, and combinations thereof.

12. The sports racquet of claim 10, wherein the first and second head regions further define a plurality of bores, and wherein each of the plurality of bores is configured to receive a corresponding one of the set of projections.

13. The sports racquet of claim 12 wherein each of the first and second frame halves has a mating surface and an outer surface, and wherein the plurality of bores and the set of projections are aligned with respect to the longitudinal axis such that when the first and second frame halves are positioned with an inner surface of the first frame half facing an inner surface of the second frame half, the first and second frame halves engage each other to form the frame.

14. The sports racquet of claim 1, wherein each of the first and second handle regions includes a plurality of structural support members.

15. The sports racquet of claim 1, wherein the first and second handle regions include first and second proximal ends respectively, wherein the first and second proximal ends define a first transverse cross-sectional area and wherein the remaining regions of the handle portion away from the proximal ends define at least a second transverse cross-sectional area, wherein the transverse cross-sectional area of the handle portion at the first and second proximal ends is greater than the transverse cross-sectional area at other locations along the remaining regions of the handle portion, and wherein the transverse cross-sectional areas are taken with respect to a plane perpendicular to the string plane.

16. The sports racquet of claim 15, wherein the first and second proximal ends form a butt end wall of the racquet, and wherein the first and second proximal ends and the butt end wall are shaped in the form of a butt cap.

17. The sports racquet of claim 1 wherein the first and second hoop regions include a distal end area, and wherein the wall thickness of the first and second hoop regions at the distal end area is greater than other locations of the first and second hoop regions such that the distal end area forms a raised bumper guard.

18. The sports racquet of claim 1, wherein the handle portion formed the first and second handle regions is configured in the shape of a pallet.

19. The sports racquet of claim 18, wherein the handle portion is shaped to replicate a contour of the pallet and a butt cap.

20. The sports racquet of claim 1, wherein each of the first and second hoop regions include the first set of projections, and wherein the first set of projections of the first hoop region are not overlapped by the first set of projections of the second hoop portion.

* * * * *